US006720719B2

(12) United States Patent
Bartch et al.

(10) Patent No.: US 6,720,719 B2
(45) Date of Patent: Apr. 13, 2004

(54) RESISTIVE COATING FOR A TENSIONED FOCUS MASK CRT

(75) Inventors: Donald Walter Bartch, York, PA (US); David Paul Ciampa, Lancaster, PA (US); Samuel Paul Benigni, Lititz, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 77 days.

(21) Appl. No.: 09/800,233

(22) Filed: Mar. 6, 2001

(65) Prior Publication Data

US 2002/0125808 A1 Sep. 12, 2002

(51) Int. Cl.[7] ..... H01J 29/80
(52) U.S. Cl. ..... 313/402; 313/403
(58) Field of Search ..... 313/402, 403–408, 313/414

(56) References Cited

U.S. PATENT DOCUMENTS

| | | | | |
|---|---|---|---|---|
| 3,742,287 A | | 6/1973 | Orthunber et al. | 315/12 |
| 4,292,619 A | | 9/1981 | Mutsaers et al. | 338/308 |
| 4,473,772 A | | 9/1984 | de Keijzer | 313/402 |
| 5,625,251 A | * | 4/1997 | Nosker et al. | 313/403 |
| 5,646,478 A | * | 7/1997 | Nosker et al. | 313/402 |
| 5,647,653 A | * | 7/1997 | Cherukuri | 313/402 |

FOREIGN PATENT DOCUMENTS

| | | |
|---|---|---|
| DE | 2900298 | 9/1978 |

* cited by examiner

*Primary Examiner*—Ashok Patel
*Assistant Examiner*—German Colón
(74) *Attorney, Agent, or Firm*—Joseph S. Tripoli; Joseph J. Laks; Carlos M. Herrera

(57) ABSTRACT

A color cathode-ray tube having an evacuated envelope with an electron gun therein for generating at least one electron beam is disclosed. The envelope further includes a faceplate panel having a luminescent screen with phosphor lines on an interior surface thereof. A tensioned focus mask, having a plurality of spaced-apart strands, is located adjacent to an effective picture area of the screen. The spacing between the strands defines a plurality of slots substantially parallel to the phosphor lines on the screen. Each of the strands has a substantially continuous insulating material layer formed on a screen-facing side thereof. A plurality of cross-wires are oriented substantially perpendicular to the plurality of strands and are bonded thereto by the insulating material layer. The plurality of cross-wires are bonded to busbars (located at opposite ends of the focus mask) with a resistive coating that has adhesive properties. The resistive coating is applied over and between each of the second conductive strands to bond them to the busbars and also to electrically isolate them from one another. A conductor is placed along a portion of at least one busbar to evenly distribute voltage to each strand through the resistive coating. The resistive coating is a composite material comprising an electrical conductor and an oxide mixed with at least one silicate glass.

4 Claims, 4 Drawing Sheets

RESISTIVE COATING FOR A TENSIONED FOCUS MASK CRT

This invention relates to a color cathode-ray tube (CRT) and, more particularly to a color CRT having a tensioned focus mask.

BACKGROUND OF THE INVENTION

A color cathode-ray tube (CRT) typically includes an electron gun for generating and directing three electron beams to a screen of the tube. The screen is located on an inner surface of the faceplate of the tube and comprises an array of elements of three different color-emitting phosphors. A color selection electrode, which may be either a shadow mask or a focus mask, is interposed between the gun and the screen, to permit each electron beam to strike only the phosphor elements associated with that beam. A shadow mask is a thin sheet of metal that is contoured to somewhat parallel the inner surface of the tube faceplate. A focus mask comprises dual sets of parallel conductors that are perpendicular to each other and usually separated by an insulative layer. The first set of parallel conductors are spaced-apart metal strands in vertical orientation and the second set of parallel conductors are metal cross-wires in horizontal orientation. Each set of parallel conductors are electrically interconnected with the strands being held under tension. The focus mask structure forms substantially rectangular openings producing quadrupolar lenses when different voltages are applied to the two sets of parallel conductors.

The large voltage differences applied between the two sets of parallel conductors creates a susceptibility to surface flashover between the conductors. Surface flashover is a breakdown process that may take place on or near the surface of the insulating material separating the two sets of parallel conductors and may lead to arcing between the conductors at one or more places on the focus mask. Since the cross-wires, which form a set of parallel conductors, are electrically connected to one another, the entire mask becomes highly susceptible to this breakdown. The system can store a substantial amount of energy in the form of a capacitor. Consequently, individual junctions between the two sets of conductors are vulnerable to a rapid and substantially complete capacitive discharge of the entire tension focus mask. This stored energy discharge may be sufficient to cause local melting of the conductors and/or the insulating material and may result in an electrical short leading to the subsequent failure of the focus mask.

Thus, a need exists to electrically isolate the individual cross-wires from each other and their designated anode to overcome the above-mentioned drawbacks.

SUMMARY OF THE INVENTION

The present invention relates to a color cathode-ray tube having an evacuated envelope with an electron gun therein for generating at least one electron beam. The envelope further includes a faceplate panel having a luminescent screen with phosphor lines on an interior surface thereof. A tensioned focus mask, having a plurality of spaced-apart strands, is located adjacent to an effective picture area of the screen. The spacing between the strands defines a plurality of slots substantially parallel to the phosphor lines on the screen. Each of the strands has a substantially continuous insulating material layer formed on a screen-facing side thereof. A plurality of cross-wires are oriented substantially perpendicular to the plurality of strands and are bonded thereto by the insulating material layer. The cross-wires are electrically connected to each other and to a conductor by a resistive material supported by a busbar formed of an electrically insulating material. The resistive coating is a composite material comprising an electrical conductor and an oxide mixed with at least one silicate glass.

BRIEF DESCRIPTION OF THE DRAWING

A preferred implementation of the principles of the present invention will now be described in greater detail, with relation to the accompanying drawings, in which.

DETAILED DESCRIPTION OF THE PREFERRED EMBODIMENT

Figure 1:
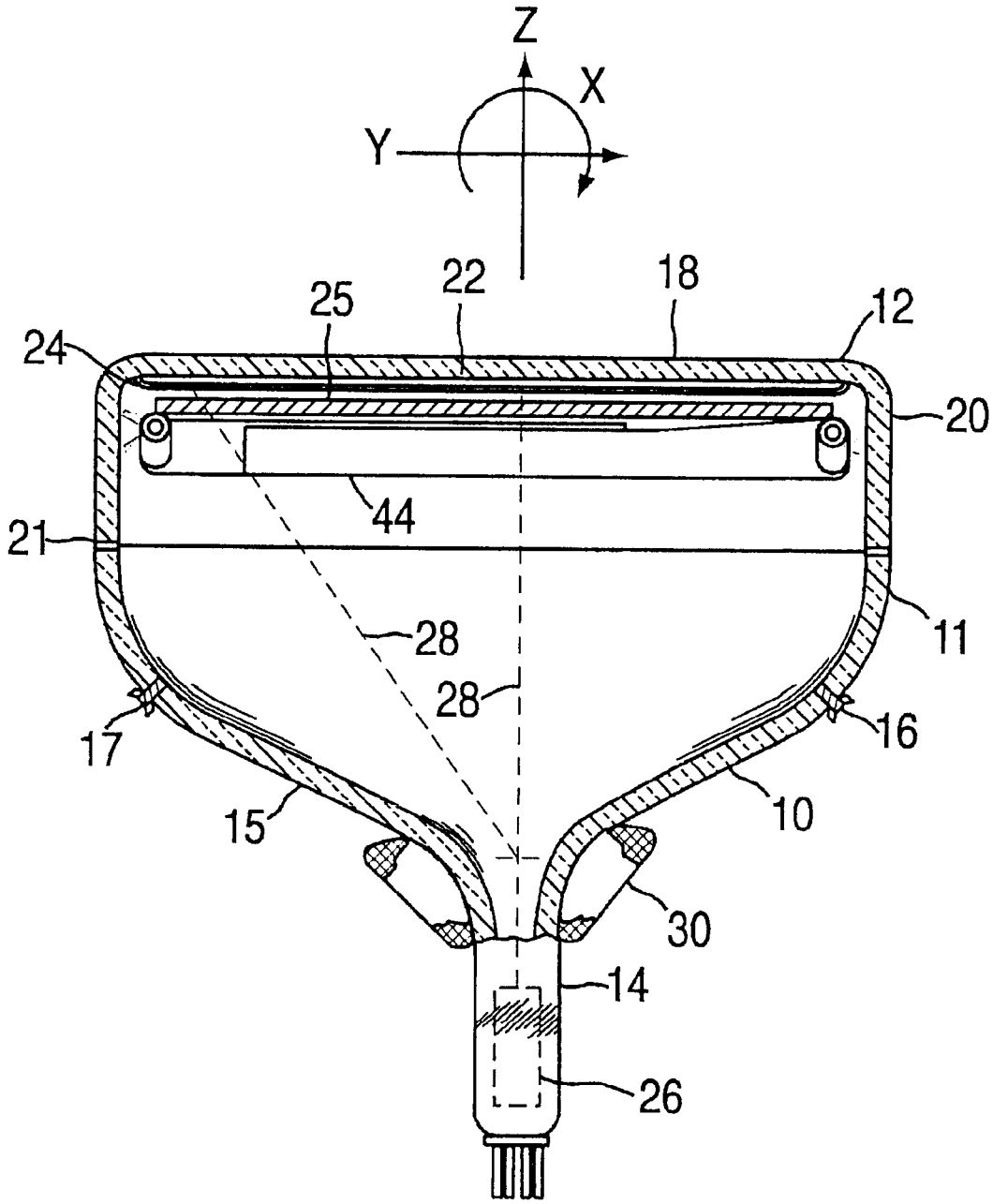
FIG. 1 is a plan view, partly in axial section, of a color cathode-ray tube (CRT) including a uniaxial tension focus mask-frame assembly embodying the present invention.

FIG. 1 shows a color cathode-ray tube (CRT) 10 having a glass envelope 11 comprising a faceplate panel 12 and a tubular neck 14 connected by a funnel 15. The funnel 15 has a first conductive coating (not shown) on the interior surface of the funnel 15 electrically joining a first anode button 16 to a mask frame 44. The funnel 15 also has a second internal conductive coating (not shown) that contacts and extends from a second anode button 17 without electrically contacting any element electrically tied to the first anode button 16.

The faceplate panel 12 comprises a viewing faceplate 18 and a peripheral flange or sidewall 20 that is sealed to the funnel 15 by a glass frit 21. A three-color luminescent phosphor screen 22 is carded by the inner surface of the faceplate 18. The screen 22 is a line screen (not shown) that includes a multiplicity of screen elements comprised of red-emitting, green-emitting, and blue-emitting phosphor lines, R, G, and B, respectively, arranged in triads, each triad including a phosphor line of each of the three colors. Preferably, a light absorbing matrix (not shown) separates the phosphor lines. A thin conductive layer (not shown), preferably formed of aluminum, overlies the screen 22 and provides means for applying a uniform first anode potential to the screen as well as for reflecting light, emitted from the phosphor elements, through the faceplate 18.

A uniaxial tension focus mask 25, is removably mounted, by conventional means, within the faceplate panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the uniaxial tension focus mask 25 to the screen 22. The inline direction of the center beam 28 is approximately normal to the plane of the paper.

The CRT of FIG. 1 is designed to be used with an external magnetic deflection yoke, such as the yoke 30, shown in the neighborhood of the funnel-to-neck junction. When activated, the yoke 30 subjects the three electron beams to magnetic fields that cause the beams to scan a horizontal and vertical rectangular raster across the screen 22.

Figure 2:
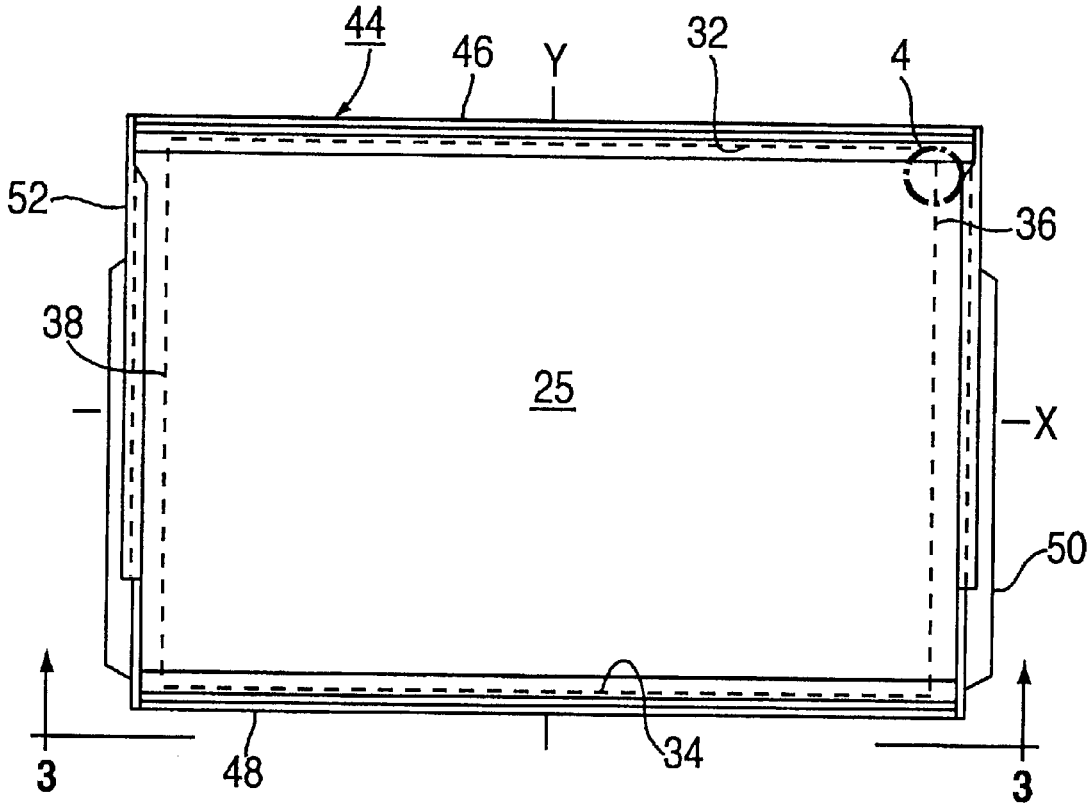
FIG. 2 is a plan view of the uniaxial tension focus mask-frame assembly of FIG. 1.
Figure 3:
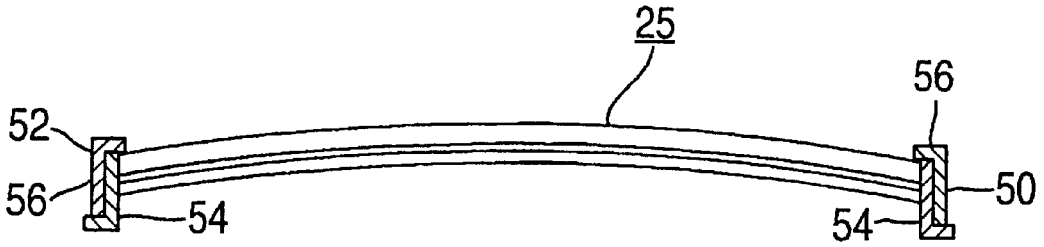
FIG. 3 is a view of the mask-frame assembly taken along line 3—3 of FIG. 2.

As shown in FIG. 2, the mask 25 includes two horizontal sides 32, 34 and two vertical sides 36, 38. The two horizontal sides 32, 34 are parallel with the central major axis, X, of the CRT while the two vertical sides 36, 38 are parallel with the central minor axis, Y, of the CRT. A frame 44, includes four major members; two torsion tubes or curved members 46, 48 and two tension arms or straight members 50, 52. The two curved members 46, 48 are parallel to the major axis, X, and each other. As shown in FIG. 3, each of the straight members 50, 52 include two overlapped partial members or parts 54, 56, each part having an L-shaped cross-section. The overlapped parts 54, 56 are welded together where they are overlapped. An end of each of the overlapped parts 54, 56 is attached to an end of one of the curved members 46, 48. The curvature of the curved members 46, 48 forms the curvature of the focus mask 25. The horizontal sides 32, 34 of the focus mask 25 are welded between the two curved members 46, 48, which provides the necessary tension to the mask.

Figure 4:
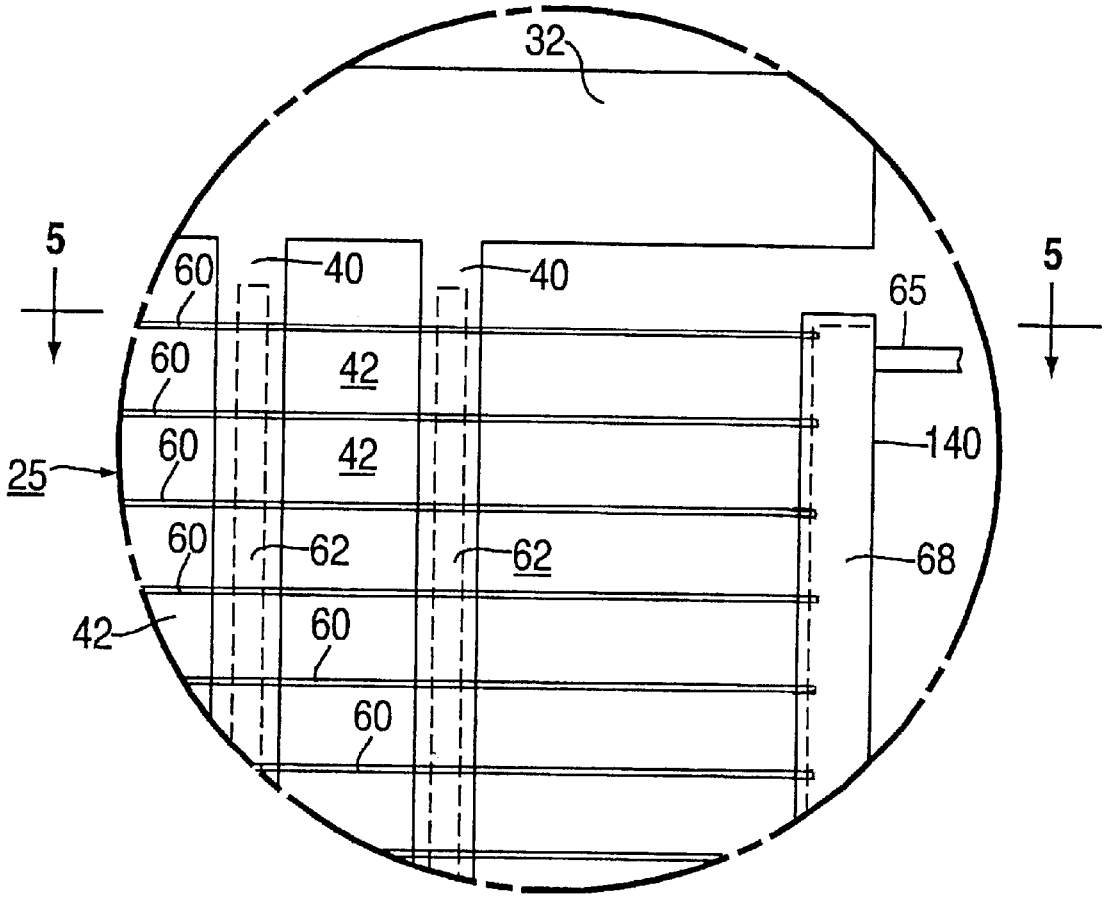
FIG. 4 is an enlarged section of the uniaxial tension focus mask shown within the circle 4 of FIG. 2.

Referring to FIG. 4, the focus mask 25 includes a plurality of metal strands 40, each having a transverse dimension, or width, of about 0.3 mm to about 0.5 mm (12–20 mils) separated by spaced slots 42, each having a width within a range of about 0.27 mm to about 0.43 mm (11–16 mils) that parallel the minor axis, Y, of the CRT and the phosphor lines of the screen 22. For a color CRT having a diagonal dimension of 68 the metal strands have widths in a range of about 0.3 mm to about 0.38 mm (12–14.5 mils) and slot 42 widths of about 0.27 mm to about 0.33 mm (11–13.3 mils). In a color CRT having a diagonal dimension of 68 cm (27 V), there are about 760 of the metal strands 40. Each of the slots 42 extends from one horizontal side 32 of the mask to the other horizontal side 34 thereof (shown in FIG. 2).

The strands 40 are formed, preferably, from a thin rectangular sheet of about 0.05 mm (2 mil) thick low carbon steel (about 0.005% carbon by weight). Suitable materials for the focus mask 25 may include high expansion, low carbon steels having a coefficient of thermal expansion (CTE) within a range of about $120–160\times10^{-7}/°$ C.; intermediate expansion alloys such as, iron-cobalt-nickel (e.g., KOVAR™) having a coefficient of thermal expansion within a range of about $40–60\times10^{-7}/°$ C.; as well as low expansion alloys such as iron-nickel (e.g., INVAR™) having a coefficient of thermal expansion within a range of about $9–30\times10^{-7}/°$ C.

Figure 5:
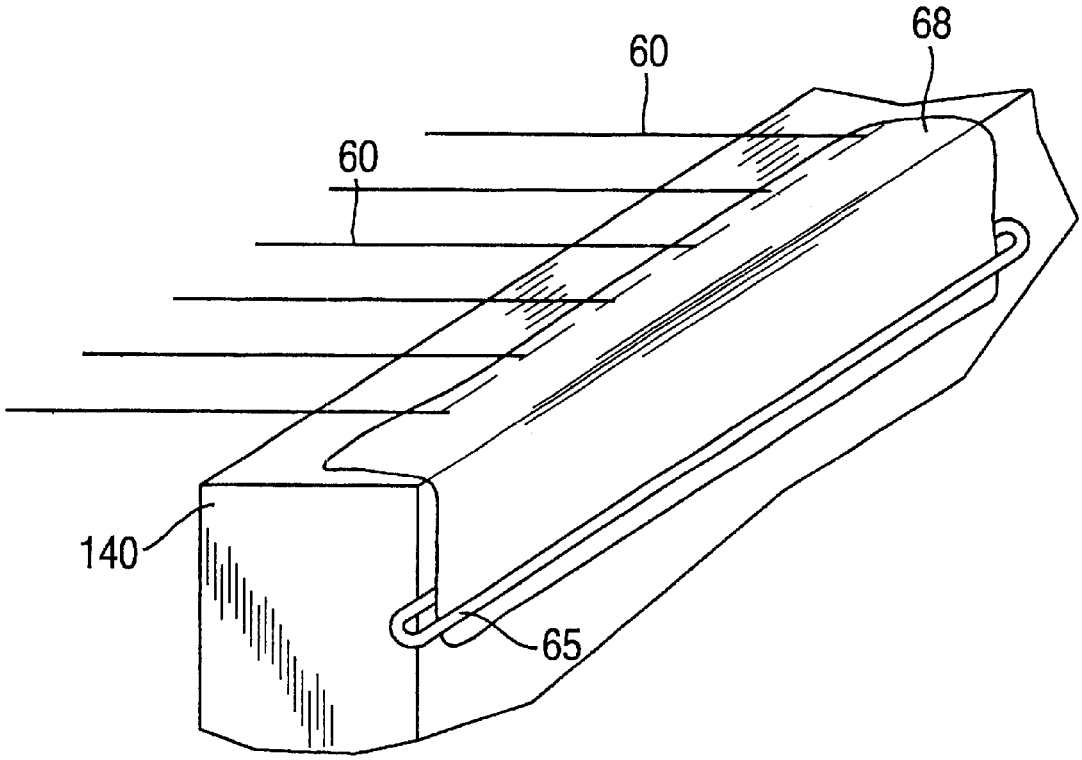
FIG. 5 is an enlarged partly broken-away perspective view of the busbar taken along lines 5—5 of FIG. 4.

With reference to FIGS. 4 and 5, a plurality of cross-wires 60, each having a diameter of about 0.025 mm (1 mil), are disposed substantially perpendicular to the strands 40 and are spaced therefrom by a layer of insulator material 62 formed on the screen-facing side of each of the strands 40. The cross-wires 60 form cross members that facilitate the application of a second anode, or focusing, potential to the focus mask 25. Suitable materials for the cross-wires 60 include iron-nickel alloys such as INVAR™ and/or high-nickel steels such as HyMu80 wire (commercially available from Carpenter Technology, Reading, Pa.).

The vertical spacing, or pitch, between adjacent cross-wires 60 is about 0.33 mm (13 mils) for a color CRT having a diagonal dimension of 68 cm (27 V). The focus mask 25 provides a mask transmission, at the center of the screen, of about 40–45%, and the second anode, or focusing, voltage, $\Delta V$, applied to the cross-wires 60, differs from the first anode voltage applied to the strands 40 by less than about 2 kV, for a first anode voltage of about 30 kV. The combination of the strands 40 and the cross-wires 60 along with the different electric potentials applied thereto function to create the quadrupole field.

The insulator material 62, is disposed substantially continuously on the screen-facing side of each of the strands 40. The cross-wires 60 are bonded to the insulator material 62 to electrically isolate the cross-wires 60 from the strands 40. The cross-wires 60 are bonded to busbars 140 (best shown in FIG. 5) located at opposite ends of the focus mask 25 with a resistive coating 68 that has adhesive properties. The resistive coating 68 is applied over and between each of the cross-wires 60 to bond them to the busbars 140 and also to electrically isolate them from one another.

A conductor 65 is placed along a portion of at least one busbar 140 and makes electrical contact with the resistive coating 68 to evenly distribute voltage to each cross-wire 60 through the resistive coating 68. A uniform electric potential is provided through the resistive coating 68 by means of a high voltage applied to the conductor 65 which is electrically in contact with the second internal coating and the second anode button 17. The conductor 65 may be made of, for example, a metal wire, a conductive paste, and/or a conductive layer. The busbar 140 is typically made of glass and has a thickness of about 2.54 mm (100 mils).

During operation of the focus mask tube, large voltage differences between the two conductors are needed to effectively focus electron beams onto their designated phosphor stripes. The voltage differential coupled with constant bombardment of electrons on the two sets of conductors 40, 60 can leave the individual junctions between the conductors 40, 60 vulnerable to a rapid and substantially complete flashover discharge of the entire tension focus mask. Such events break down the insulator to the extent that the two sets of conductors 40, 60 become electrically tied together. Hence, this destroys the efficacy of the focus mask 25 to focus the beams.

One group of composite materials when used as resistive coatings 68 have substantially mitigated the impact of high voltage flashover. These composite materials comprise an electrical conductor and an oxide mixed with at least one silicate glass. The ratio of the oxide to the electrical conductor in the composite material is used to control the resistivity thereof. The ratio of the oxide to the electrical conductor is preferably within a range of about 4:1 to about 10:1. The resistive coating preferably has a resistivity within a range of about 5 kΩ to about 200 kΩ.

Suitable oxides may include, for example, aluminum oxide ($Al_2O_3$), iron oxide ($Fe_2O_3$), and titanium dioxide ($TiO_2$), among others. Suitable electrical conductors may include, for example, graphite, antimony, and silver, among others. Suitable silicate glasses may include, for example, potassium silicate, sodium silicate, lead-zinc-borosilicate glass, and devitrifying glass, among others.

According to a preferred method of making the focus mask 25, a first coating of the insulator material 62 is provided, e.g., by spraying, onto the screen-facing side of the strands 40. The strands 40, in this example, are formed of a low expansion alloy, such as INVAR™, having a coefficient of thermal expansion within the range of $9–30\times10^{-7}/°$ C. Preferably the insulator material coating is a lead-zinc-borosilicate glass such as SCC-11 or a lead oxide (PbO) doped with about 7% iron oxide ($Fe_2O_3$). The first coating of the insulator typically has a thickness of about 0.05 mm to about 0.09 mm (2–3.5 mils).

The frame 44, including the coated strands 40, is dried at room temperature. After drying, the first coating of the insulator material 62 is hardened (cured) by heating the frame 44 including the strands 40, in an oven. The frame 44 is heated over a period of about 30 minutes to a temperature of about 300° C., and held at 300° C., for about 20 minutes. Then, over a period of 20 minutes, the temperature of the oven is increased to about 460° C., and held at that temperature for two hours to melt and crystallize the first coating and form a first layer of insulator material 62 on the strands 40. The first layer of insulator material 62, after firing, will typically not remelt. The first layer of insulator material 62 is typically dome-shaped and has a thickness within a range of about 0.05 mm to about 0.09 mm (2 to 3.5 mils) across each of the strands 40.

After the first coating of the insulator is hardened, a second coating of the insulator material is applied over the first coating of the insulator material. The second coating of the insulator material has the same composition as the first coating. The second coating of the insulator material may optionally have a different composition from that of the first coating. The second coating of the insulator material has a thickness of about 0.0025 mm to about 0.05 mm (0.1 to 2 mils).

Thereafter, the cross-wires 60 are applied to the frame 44, over the second coating of the insulator material, such that the cross-wires 60 are substantially perpendicular to the strands 40. The cross-wires 60 are applied using a winding fixture (not shown) that accurately maintains a desired spacing of for example, about 0.33 mm (13 mils) between adjacent metal strands for a color CRT having a diagonal dimension of about 68 cm (27 V).

The cross-wires 60, when wound, also contact a resistive coating 68 formed along the top and a portion of the side of the busbar 140 as well as the top of the other busbar (not shown). Alternatively, and additionally, a layer of the resistive coating may be applied to the cross-wires 60 as well as the busbars 140, after the winding operation. The resistive coating 68 has a thickness of about 0.07 to 0.15 mm (3 to 5 mils).

The frame 44, including the winding fixture, is heated to a temperature of about 460° C. for about 120 minutes to cure the second coating of the insulator material. Following curing, any excess cross-wire is removed and the frame is taken out of the holding device, electrical connections are made to the strands and cross-wires, and the tensioned focus mask is inserted into a tube envelope.

What is claimed is:

1. A cathode-ray tube comprising an evacuated envelope having therein an electron gun for generating at least one electron beam, a faceplate panel having a luminescent screen with phosphor lines on an interior surface thereof; and a tensioned focus mask, wherein the tensioned focus mask includes a plurality of spaced-apart strands having an insulating material thereon, and a plurality of spaced-apart cross-wires oriented substantially perpendicular to the plurality of spaced-apart strands, the plurality of spaced-apart cross-wires being bonded to the insulating material, wherein:

the plurality of spaced-apart cross-wires are electrically connected to each other and to a conductor with a resistive coating disposed on at least a portion of an electrically insulative bus bar wherein the resistive coating comprises a composite material including an electrical conductor and an oxide mixed with at least one silicate glass wherein the ratio of said oxide to said electrical conductor is within a range of 4:1 to 10:1 by weight.

2. The cathode-ray tube of claim 1 wherein the silicate glass comprises one or more materials selected from the group consisting of lead-zinc-borosilicate glass and devitrifying glass.

3. The cathode-ray tube of claim 1 wherein the electrical conductor in the composite resistive coating is selected from the group consisting of antimony and silver.

4. The cathode-ray tube of claim 1 wherein the oxide is selected from the group consisting of aluminum oxide ($Al_2O_3$) and titanium dioxide ($TiO_2$).

* * * * *